United States Patent [19]

Keller

[11] Patent Number: 4,506,132

[45] Date of Patent: Mar. 19, 1985

[54] INDUCTION COIL IN THE FORM OF A FLAT COIL FOR CRUCIBLE-FREE FLOATING ZONE MELTING

[75] Inventor: Wolfgang Keller, Munich, Fed. Rep. of Germany

[73] Assignee: Siemens Katiengesellschaft, Berlin and Munich, Fed. Rep. of Germany

[21] Appl. No.: 426,781

[22] Filed: Sep. 29, 1982

[30] Foreign Application Priority Data

Oct. 30, 1981 [DE] Fed. Rep. of Germany ..... 3143146

[51] Int. Cl.[3] ..... H05B 6/36

[52] U.S. Cl. ..... 219/10.79; 219/10.49 R

[58] Field of Search ..... 219/10.43, 10.49 R, 219/10.79, 10.53; 156/600-605; 373/139

[56] References Cited

U.S. PATENT DOCUMENTS 3,644,151 2/1972 Keller ..... 148/1.6

3,827,017 7/1974 Keller ..... 219/10.43

FOREIGN PATENT DOCUMENTS 2337342 3/1979 Fed. Rep. of Germany .

*Primary Examiner*—Roy N. Envall, Jr.
*Assistant Examiner*—Marvin M. Lateef
*Attorney, Agent, or Firm*—Herbert L. Lerner; Laurence A. Greenberg

[57] ABSTRACT

Flat induction heating coil for crucible-free floating zone melting a semiconductor crystalline rod having a turn annularly surrounding the semiconductor rod, the turn being formed with at least one passage therethrough for a cooling liquid, including an energy concentrator located at an inner side of the heating coil turn facing towards the semiconductor rod to be melted, the energy concentrator being subdivided into a plurality of segments electrically isolated from one another.

24 Claims, 4 Drawing Figures

1
2
3
4
5
6
7
8
9
10
11
12
13
14
15

16
17
18
19
20
21

INDUCTION COIL IN THE FORM OF A FLAT COIL FOR CRUCIBLE-FREE FLOATING ZONE MELTING

The invention relates to an induction coil in the form of a flat coil for crucible-free floating zone melting.

Devices for crucible-free zone melting of crystalline rods frequently have an induction heating coil for heating the melting zone, the heating coil being located in the melting chamber near holders for the ends of the rods. Due to a relative movement between the rod holders, on the one hand, and the induction heating coil, on the other hand, this melting zone is moved through the crystalline rod. The induction heating coil may be, for example, a multi-turn cylindrical coil. Frequently the induction coil is also a single-turn coil. These induction heating coils are energized with high-frequency alternating current from a high-frequency generator.

The melting chamber may largely be evacuated but may, however, also be filled with a protective gas. Highly pure hydrogen as well as argon have been proposed heretofore as protective gas charges, wherein rod-shaped single crystals having especially good crystal quality may be produced by crucible-free floating zone melting.

Multi-turn coils, especially, but also single-turn coils have a tendency towards electrical flash-overs during the performance of a crucible-free zone melting process. These flash-overs may have a damaging effect upon the crystal quality of the crystalline rod produced by the crucible-free zone melting process.

The danger of flash-overs is especially great in a melting chamber filled with protective gas and/or for coils operating at high power. It is accordingly an object of the invention to provide a crucible-free zone melting device wherein such flash-overs are prevented.

The invention of the instant application is therefore related to a device for crucible-free zone melting a crystalline rod, such as a semiconductor rod, for example, having a melting chamber wherein holders for the ends of the rod are disposed, as well as an induction heating coil for heating the melting zone, the heating coil surrounding the rod.

Such a device has become known heretofore from German Pat. No. 19 13 881, wherein a middle turn section of the induction heating coil and the crystalline rod are connected at the same electric potential during the melting-zone passage.

In a further development of this idea, the middle turn section or part or the middle turn of the induction heating coil and at least one of the rod holders are electrically connected to one another.

An electrical balancing member such as a balanced-to-unbalanced transformer can also be connected in parallel with the induction heating coil and can have a central tap electrically connected to at least one rod holder.

Figure 1:
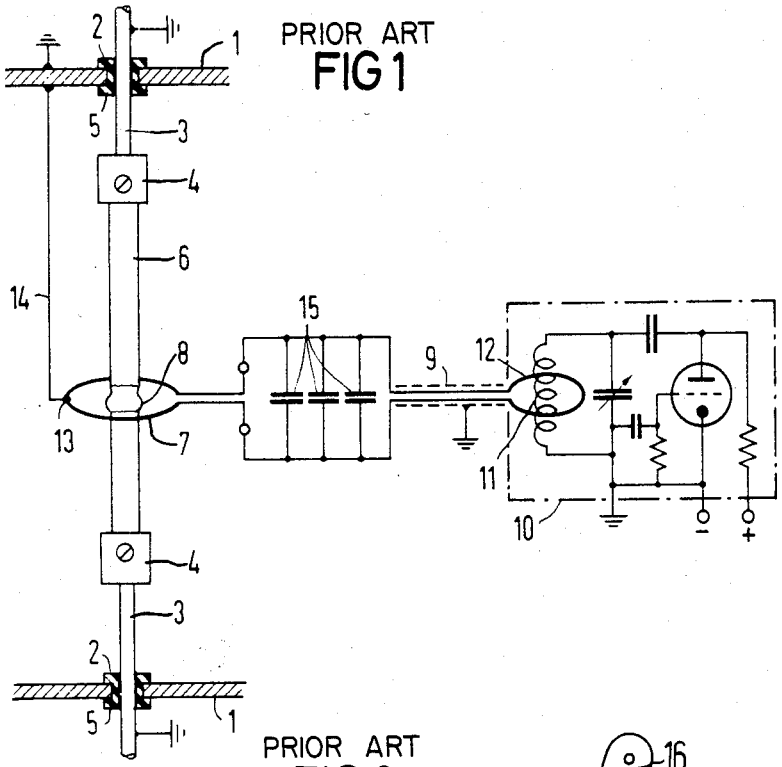
PRIOR ART FIG 1

Such a heretofore known device is shown in FIG. 1 with part of a metallic wall 1 of the melting chamber for crucible-free zone melting a crystalline rod. In this wall 1, lead-throughs 2 are provided wherein metal shafts 3 with metal rod-holders 4 are disposed. The lead-throughs 2 are sealed gas-tightly with a retaining ring seal 5. The shafts 3 and the rod holders 4 therewith can be rotated about the longitudinal axis of the shafts 3 and can be shifted likewise also in axial direction of the shafts 3. A respective end of a crystalline rod 6, such as a rod formed of silicon, for example, is fastened in the rod holders 4. With the aid of an induction heating coil 7, a molten zone 8 is formed in the rod 6 and is moved along the rod 6 as a result of relative movement between the rod 6 and the induction heating coil 7. The melting chamber, which has not been fully illustrated in FIG. 1, may be filled, for example, with a highly pure hydrogen or with argon.

Capacitors 15 are connected in parallel with the induction heating coil 7. The induction heating coil 7 and the capacitors 15 form a heating circuit, which is an oscillating circuit supplied with electrical energy from a high-frequency generator 10 via a coaxial line 9. The coaxial line 9 and, accordingly, the heating circuit formed by the induction heating coil 7 and the capacitors 15 are coupled via a coupling coil 12 to an oscillating coil 11 of a tank circuit in the high-frequency generator 10.

The middle turn section 13 of the single-turn induction coil 7 or the middle turn of a non-illustrated cylindrical induction heating coil, respectively, is connected to the wall 1 of the melting chamber via an electric line 14. Both the rod holders 4 and the rod 6 therewith, as well as the middle turn section 13 of the induction heating coil 7 have the same potential because the shafts 3 and the wall 1 of the melting chamber are grounded. The maximum potential difference between the induction heating coil 7 and the crystalline rod 6 is thereby only half as great as it would be if the middle section 13 of the induction heating coil were not connected electrically conductively to the melting-chamber wall 13 and therefore did not have the same potential as that of the rod 6.

Electrical flash-overs have not since then been observed any more with the conventional silicon rods having a diameter of from one to two inches.

Relatively high voltages are required at the melting coil when fusing the seed crystal to the rod and when pulling the bottle-shaped thin-section at the beginning of the zone-melting process, because of the relatively poor coupling between coil and molten zone. The larger the inner diameter of the melting coil formed, for example, of a flat coil, the easier glow discharges or flash-overs have occurred in the coil slot, especially when argon is used as protective gas. These flash-overs have a very damaging effect upon the crystal quality of the semiconductor material produced by the crucible-free floating zone melting and, furthermore, disrupt the high-frequency coil as well as feed lines.

The trend towards ever thicker rods of three, four and more inches diameter compels, of course, towards a new solution.

The invention is based upon the realization that the basic conception of conventional flat coils, such as are known, for example, from German Published Non-Prosecuted Application (DE-OS) No. 23 37 342, is maintained; however, they must be completely newly constructed, with respect to the electric strength thereof.

It is accordingly an object of the invention to provide an induction coil in the form of a flat coil for crucible-free floating zone melting having a much improved electric strength over heretofore known coils of similar general type.

With the foregoing and other objects in view, there is provided, in accordance with the invention, a flat induction heating coil for crucible-free floating zone melting a semiconductor crystalline rod having a turn annularly surrounding a semiconductor rod, the turn being formed with at least one passage therethrough for a cooling liquid, comprising a flat induction heating coil for crucible-free zone melting a semiconductor crystalline rod having a turn annularly surrounding the semiconductor rod, the turn being formed with at least one passage therethrough for a cooling liquid, comprising an energy concentrator located at an inner side of the heating coil turn facing towards the semiconductor rod to be melted, the energy concentrator being subdivided into a plurality of segments electrically isolated from one another.

In accordance with another feature of the invention, the segments are of equal size.

In accordance with a further feature of the invention, the energy concentrator is subdivided into a number of segments selected from the group consisting of 2, 3, 4 and 6 segments.

In accordance with an additional feature of the invention, the coil turn is disposed in a given plane, and the energy concentrator is also disposed in the given plane.

In accordance with an added feature of the invention, the energy concentrator is electrically isolated from the coil turn.

In accordance with yet another feature of the invention, the coil includes a temperature-resistant insulating material for mutually isolating the segments.

In accordance with yet a further feature of the invention, the coil includes a temperature-resistant insulating material for isolating the energy concentrator from the coil turn.

In accordance with yet an additional feature of the invention, the segments of the energy concentrator are spaced approximately 1 to 2 mm from the coil turn.

The fundamental idea of these features is to divide the coil into a primary and a secondary circuit in order then to divide the electrical field of the coil by separating it into segments, so that the alternating magnetic field is fully maintained.

In accordance with yet added features of the invention, the segments are formed with recesses extending towards a center whereat they constitute together a circular opening for the semiconductor rod having a diameter of about 25 to 35 mm.

In accordance with another feature of the invention, the individual segments of said energy concentrator are formed with at least one passage therethrough traversible by a cooling liquid.

In accordance with a further feature of the invention, the segments, respectively, are hollow members, the passage extending through the hollow interior thereof.

In accordance with an alternate feature of the invention, the passages extend through bores formed in the segments.

In accordance with yet another feature of the invention, and especially important for the electric strength of the coil, each of the concentrator segments has a ground potential terminal in a middle region thereof. The segments may also have applied thereto the same potential as isolated rod holders.

In accordance with yet an added feature of the invention, each of the segments has a thickness increasing from the interior to the exterior of the energy concentrator.

In accordance with yet an additional feature of the invention, the segments, respectively, flare conically outwardly.

In accordance with another feature of the invention, the segments at the outer sides thereof, are formed with indentations wherein the heating-coil turn is fitted.

In accordance with a further feature of the invention, the coil turn fitted in the indentations are spaced from the surface of the segments defining the indentations, and including temperature-resistant insulating material filling the space in the indentations between the coil turn and the surface of the segments.

In accordance with another feature of the invention, the temperature-resistant insulating material is a material selected from the group consisting of ceramic, silicon rubber, silicon resin and polybismaleinimide.

In accordance with an additional feature of the invention, the segments decrease in width towards the center of the energy concentrator and has a radius of curvature of from 0.5 to 2 mm at the inside thereof.

In accordance with an added feature of the invention, the segments have a radially outer side with a thickness of approximately 10 to 30 mm.

In accordance with yet another feature of the invention, the indentations formed in the segments are approximately 20 mm deep.

In accordance with yet a further feature of the invention, there is provided an outer diameter of about 100 to 200 mm.

In accordance with yet an additional feature of the invention, the coil turn is formed of material selected from the group consisting of copper, copper with silver plating, and silver.

In accordance with a concomitant feature of the invention, the segments are formed of material selected from the group consisting of copper, cooper with silver plating, and silver.

In order to be able to zone-melt semiconductor crystalline rods having relatively large rod diameters, in accordance with another embodiment of the invention, the the induction heating coil is of disassemblable construction, the coil and the segments representing two separate components which are connected to one another by threaded connections and seals provided for the cooling system.

Also, the flow and cooling-medium feeds may be constructed so as to be axially displaceable, whereby the inner diameter of the heating device is variable.

Other features which are considered as characteristic for the invention are set forth in the appended claims.

Although the invention is illustrated and described herein as embodied in an induction coil in the form of a flat coil for crucible-free floating zone melting, it is nevertheless not intended to be limited to the details shown, since various modifications and structural changes may be made therein without departing from the spirit of the invention and within the scope and range of equivalents of the claims.

Figure 2:
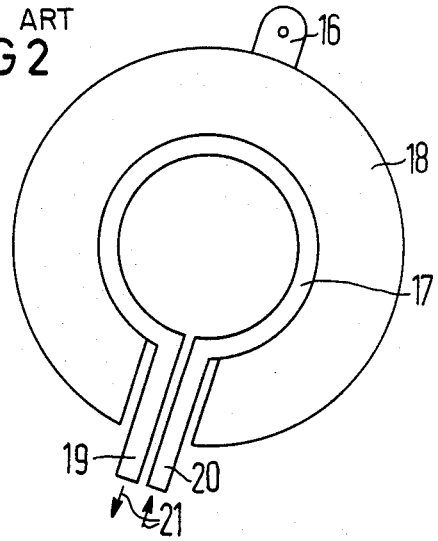
PRIOR ART FIG 2
Figure 3:
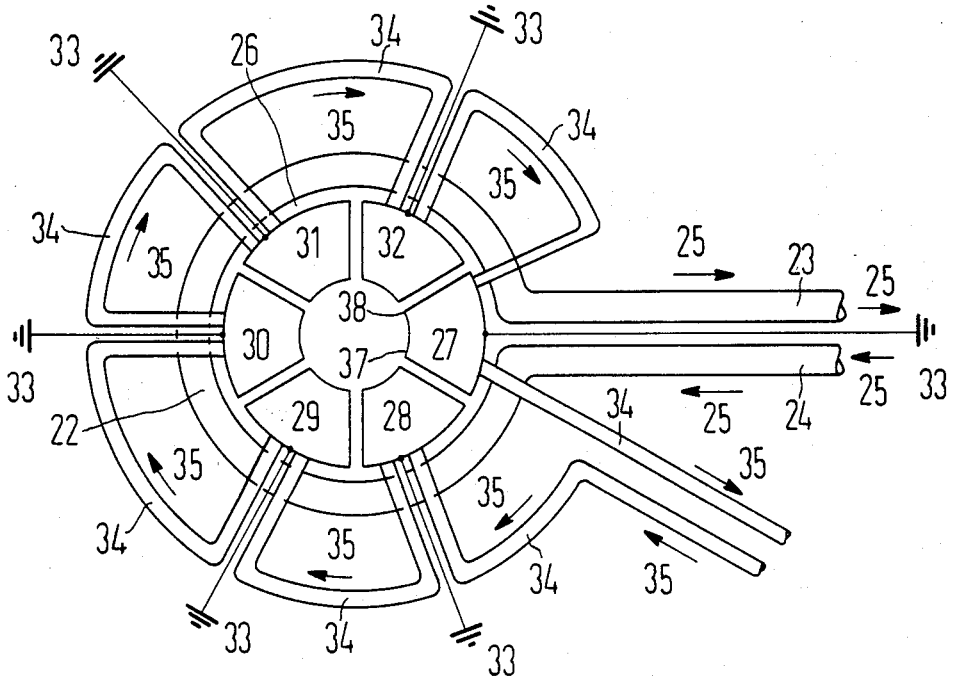
Figure 4:
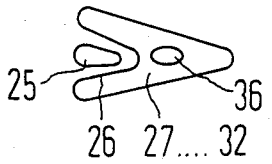

The construction and method of operation of the invention, however, together with additional objects and advantages thereof will be best understood from the following description of the drawngs, in which:

FIG. 1. referred to hereinbefore, is a diagrammatic and schematic view of a device for crucible-free floating zone melting a crystalline rod as known in the Prior Art;

FIG. 2 is a much enlarged, fragmentary plan view of FIG. 1 showing a flat induction coil known in the PRIOR ART; and FIG. 3 is a diagrammatic and partly schematic plan view of a flat heating coil constructed in accordance with the invention of the instant application, as well as the energizing circuit therefor; and FIG. 4 is a fragmentary side elevational view of FIG. 3 showing a segment of the energy concentrator.

Referring again to the drawing and now, more specifically, to FIG. 2 thereof, there is shown in plan view a conventional flat coil over which the novel flat coil of the instant application is a marked advancement. The coil of FIG. 2 is formed of a ring-shaped inner turn section 17 having an oval cross section, and an outer turn section 18 constructed in the form of a collar. Both turn sections 17 and 18 are connected to one another by a welding seam. The outer turn section 18 embodies an extension piece in the form of an eye 16 at which the coil is grounded. Two current feeds 19 and 20 for the coils are connected to the inner section 17 and serve simultaneously as cooling water feeds, the flow of water therethrough being signified by the appropriately directed arrows 21. Generally, the outer turn section 18 of the coil is of solid construction and formed of silvered copper, whereas the inner turn section 17 is produced from a copper tube.

Referring again to the drawings and more specifically to FIG. 3 thereof, there is shown the induction heating coil according to the invention which is formed of a single-turn flat coil 22, to the ends 23 and 24 of which a high-frequency voltage of, for example, 1,000 volts is applied. The coil is traversed by water, as indicated by the arrows 25, for the purpose of cooling.

At the inner side of the single-turn flat coil 22 facing towards the semiconductor rod to be melted, an energy concentrator is disposed with a spacing 26 of, for example, 1 mm away from the coil 22. The energy concentrator is formed of six segments 27 to 32. The spacing 26 serves for electrically isolating the coil 22 from the segments 27 to 32 and is filled with temperature-resistant silicon rubber. Each of the segments 27 to 32 mutually isolated for example, with silicon rubber has a middle terminal 33 connected to ground potential. In the simplest case, the segments are formed as hollow copper members so that they may quite comfortably or suitably be connected to a cooling line system.

In the embodiment shown in FIG. 3, the individual segments are mutually connected by pipelines 34 and are successively traversed by cooling water, as indicated by the arrows 35. It stands to reason that the cooling water guidance can be effected in parallel operation or combined in groups.

In practice, a coil proves successful when the opening thereof for passing therethrough the semiconductor rod to be melted, that opening being formed or defined by the segments, has a diameter of 32 mm for a heating-coil outer diameter of 150 mm.

A technically elegant solution is afforded, as shown in FIG. 4, by providing that the segments 27 to 32, which should have a thickness increasing from inside to the outside, preferably extending conically, be formed on the outsides thereof with indentations wherein the heating coil 25 is fitted. The intermediate space 26 is filled with temperature-resistance silicon rubber. Cooling of the segment is effected through a bore 36 by the flow of water therethrough.

If the segments have a thickness of about 20 mm on the outside thereof, and a radius of curvature of 1 mm on the inside thereof, then, in spite of the bore 36, the indentation 26 formed in the segments for receiving the heating coil 25 therein may be made 20 mm deep.

The number of segments isolated or insulated from one another is unlimited, in principle. The number is reduced only due to mechanical expense which is technically yet justifiable. At 1,000 volts potential at the heating coil, six segments are indeed optimal for the energy concentrator, as far as the electric strength is concerned, however, because of the ever increasing expense in practice it is well enough also the maximum.

With six segments, one sixth of the full voltage is alloted to each segment. If use is then made yet of the middle ground of each segment, the voltage of each segment divides in half once again with respect to the grounded melt (analogous to the voltage division according to German Pat. No. 19 13 881). The critical voltage between the melt and the high-frequency heating is accordingly depressed to a twelfth of the coil voltage. With 1,000 volts coil potential, this means that the segment ends, for example, 27 and 38 of segment 27, have only a voltage yet of less than 85 volts with respect to the rod melt.

The foregoing is a description corresponding to German Application No. P 31 43 146.1, dated Oct. 30, 1981, International priority of which is being claimed for the instant application, and which is hereby made part of this application. Any discrepancies between the foregoing specification and the aforementioned corresponding German application are to be resolved in favor of the latter.

There are claimed:

1. Flat induction heating coil for crucible-free zone melting a semiconductor crystalline rod having a turn annularly surrounding the semiconductor rod, the turn being formed with at least one passage therethrough for a cooling liquid, comprising an energy concentrator located at an inner side of the heating coil turn facing towards the semiconductor rod to be melted, said energy concentrator being electrically isolated from the coil turn and being subdivided into a plurality of segments electrically isolated from one another.

2. Coil according to claim 1 wherein said segments are of equal size.

3. Coil according to claim 1 wherein said energy conecntrator is subdivided into a number of segments selected from the group consisting of 2, 3, 4 and 6 segments.

4. Coil according to claim 1 wherein the coil turn is disposed in a given plane, and said energy concentrator is also disposed in said given plane.

5. Coil according to claim 1 including a temperature-resistant insulating material for mutually isolating said segments.

6. Coil according to claim 1 including a temperature-resistant insulating material for isolating said energy concentrator from the coil turn.

7. Coil according to claim 1 wherein said segments of said energy concentrator are spaced approximately 1 to 2 mm from the coil turn.

8. Coil according to claim 1 wherein said segments are formed with recesses extending towards a center whereat they constitute together a circular opening for the semiconductor rod.

9. Coil according to claim 8 wherein said circular opening defined by said segments has a diameter of approximately 25 to 35 mm.

10. Coil according to claim 1 wherein the individual segments of said energy concentrator is formed with at least one passage therethrough traversible by a cooling liquid.

11. Coil according to claim 10 wherein said segments, respectively, are hollow members, said passage extending through the hollow interior thereof.

12. Coil according to claim 10 wherein said passages extend through bores formed in said segments.

13. Coil according to claim 1 wherein each of said concentrator segments has potential terminals in a middle region thereof.

14. Coil according to claim 1 wherein each of said segments has a thickness increasing from the interior to the exterior of said energy concentrator.

15. Coil according to claim 14 wherein said segments, respectively, flare concially outwardly.

16. Coil according to claim 1 wherein said segments at the outer sides thereof, are formed with indentations wherein the heating-coil turn is fitted.

17. Coil according to claim 16 wherein the coil turn fitted in the indentations are spaced from the surface of said segments defining said indentations, and including temperature-resistant insulating material filling the space in said indentations between the coil turn and the surface of said segments.

18. Coil according to claim 5, 6 or 17 wherein said temperature-resistant insulating material is a material selected from the group consisting of ceramic, silicon rubber, silicon resin and polybismaleinimide.

19. Coil according to claim 1 wherein said segments decrease in width towards the center of said energy concentrator and has a radius of curvature of from 0.5 to 2 mm at the inside thereof.

20. Coil according to claim 1 wherein said segments have a radially outer side with a thickness of approximately 10 to 30 mm.

21. Coil according to claim 16 wherein said indentations formed in said segments are approximately 20 mm deep.

22. Coil according to claim 1 having an outer diameter of about 100 to 200 mm.

23. Coil according to claim 1 wherein said coil turn is formed of material selected from the group consisting of copper, copper with silver plating, and silver.

24. Coil according to claim 1 wherein said segments are formed of material selected from the group consisting of copper, copper with silver plating, and silver.

* * * * *